US006273582B1

(12) United States Patent
Taggart et al.

(10) Patent No.: US 6,273,582 B1
(45) Date of Patent: Aug. 14, 2001

(54) COMPACT MULTIPLE FUNCTION TOOL

(75) Inventors: John Merrick Taggart, Cromwell; A. Jeffrey Turner, Madison; Edward S. Richardson, Fairfield, all of CT (US); Daniel J. Nelsen, Providence, RI (US); Stephen E. Lane, Jamestown, RI (US); Marc Harrison, Portsmouth, RI (US); Daniel P. Smith, Cranston, RI (US); Michael C. Pereira, Lincoln, RI (US); Aidan J. Petrie, Providence, RI (US)

(73) Assignee: Swiss Army Brands, Inc., Shelton, CT (US)

( * ) Notice: Subject to any disclaimer, the term of this patent is extended or adjusted under 35 U.S.C. 154(b) by 0 days.

(21) Appl. No.: 09/310,327

(22) Filed: May 12, 1999

(51) Int. Cl.[7] ..... B25B 23/18
(52) U.S. Cl. ..... 362/119; 362/253; 7/118
(58) Field of Search ..... 362/119, 120, 362/253, 109; 7/135, 118, 160

(56) References Cited

U.S. PATENT DOCUMENTS

| | | | |
|---|---|---|---|
| D. 238,436 | | 1/1976 | McKelvey . |
| D. 318,625 | | 7/1991 | Stowell . |
| D. 336,415 | | 6/1993 | Cheng . |
| D. 368,634 | | 4/1996 | Frazer . |
| D. 371,498 | | 7/1996 | Lai . |
| D. 380,362 | | 7/1997 | Rivera . |
| D. 382,182 | | 8/1997 | Seber et al. . |
| D. 382,190 | | 8/1997 | Blackston et al. . |
| D. 384,872 | | 10/1997 | Yeh . |
| D. 385,168 | | 10/1997 | Rivera . |
| 674,036 | | 5/1901 | Metcalf . |
| 858,003 | | 6/1907 | Klever . |
| 4,238,862 | | 12/1980 | Leatherman . |
| 4,478,330 | * | 10/1984 | Lin ..... 206/38 |
| 4,744,272 | | 5/1988 | Leatherman . |
| 4,783,867 | | 11/1988 | Tsao ..... 7/160 |
| 4,805,303 | | 2/1989 | Gibbs . |
| 4,854,045 | * | 8/1989 | Schaub ..... 30/155 |
| 4,856,132 | | 8/1989 | Burns et al. . |
| 4,888,869 | | 12/1989 | Leatherman . |
| 4,918,775 | | 4/1990 | Leu . |
| 4,998,726 | | 3/1991 | Budnick . |
| 5,007,129 | | 4/1991 | Hainey . |
| 5,054,777 | | 10/1991 | Borden et al. . |
| 5,062,173 | | 11/1991 | Collins et al. . |
| 5,072,634 | | 12/1991 | Ryder . |

(List continued on next page.)

FOREIGN PATENT DOCUMENTS

| | | |
|---|---|---|
| 30788 | 3/1885 | (DE) . |
| WO 97/19787 | 6/1997 | (WO) . |

*Primary Examiner*—Sandra O'Shea
*Assistant Examiner*—John Anthony Ward
(74) *Attorney, Agent, or Firm*—Pennie & Edmonds LLP

(57) ABSTRACT

A multiple function combination business travel tool combines a plurality of individual business-oriented implements in a single compact and reduced configuration for many diverse business-oriented travel needs. The tool includes a flashlight positioned along a scale, or wide side, of the tool such that a lightbulb and reflector larger than those provided along the side of prior art tools may be provided. The tool also preferably includes a clock, preferably in the form of a digital alarm clock, and a plurality of deployable implements, preferably selected with the needs of a business traveller in mind. In one embodiment, the tool includes a pair of handles having implement channels and scissor channels, the handles forming the handles of a deployable scissors whose blades are stored in the scissor channels. Deployment of the scissor blades is achieved by rotation thereof about axles by which the blades are respectively coupled to the tool handles, thereby forming scissors with the first and second tool handles functioning as handles of the scissors.

29 Claims, 12 Drawing Sheets

U.S. PATENT DOCUMENTS

| | | | | |
|---|---|---|---|---|
| 5,142,721 | | 9/1992 | Sessions et al. . | |
| 5,160,134 | | 11/1992 | McDonald . | |
| 5,212,844 | | 5/1993 | Sessions et al. . | |
| 5,251,351 | | 10/1993 | Klotz . | |
| 5,267,366 | | 12/1993 | Frazer . | |
| 5,313,376 | | 5/1994 | McIntosh . | |
| 5,388,824 | | 2/1995 | Reimers . | |
| 5,419,551 | | 5/1995 | Hoyt et al. . | |
| 5,562,553 | | 10/1996 | Digerness et al. . | |
| 5,573,109 | * | 11/1996 | Isacson | 206/38.1 |
| 5,578,992 | * | 11/1996 | Harding | 340/574 |
| 5,653,525 | * | 8/1997 | Park | 362/119 |
| 5,661,908 | | 9/1997 | Chen . | |
| 5,664,274 | | 9/1997 | Collins . | |
| 5,689,886 | | 11/1997 | Yeh . | |
| 5,697,114 | | 12/1997 | McIntosh et al. . | |
| 5,743,582 | | 4/1998 | Rivera | 294/99 |
| 5,745,997 | | 5/1998 | Berg et al. | 30/155 |
| 5,857,268 | * | 1/1999 | Park | 30/146 |
| 6,027,224 | * | 2/2000 | Schnell | 362/119 |

* cited by examiner

COMPACT MULTIPLE FUNCTION TOOL

BACKGROUND OF THE INVENTION

1. Field of the Invention

The present invention relates generally to the field of multiple function compound tools, and in particular to a tool adapted for use in conjunction with a briefcase and like business travel accessories.

2. Description of Related Art

On occasion, travellers have a need for various tools and other implements to address diverse situations. For example, business travellers typically use timepieces and writing implements in order to conduct business, for example, in meetings and conferences. Further, business travellers may need eyeglass repair implements in the event that one must repair one's eyeglasses in order to conduct business.

While such implements may typically be small in size for ease of carrying and of use, it is cumbersome to carry multiple individual implements in one's attire and/or carrying cases. Furthermore, the small size of such implements may also cause such tools to be difficult to locate in a carrying case or in one's attire, including one's pockets. Moreover, implements of such small size are relatively easy to lose in such attire or carrying cases. Alternatively, multiple implements such as nail clippers may be connected together by chains or string to nail files, keychains, etc. However, such connected combinations of individual and disparate implements may be unwieldy to manipulate and store in one's attire or carrying cases.

In addition, such individual implements are readily obtainable from stores and shops, especially such shops, for example, in airports and railroad terminals which cater to travellers such as business people. However, business travellers may lack the time and/or the money to purchase necessary implements for the various uses described above.

Compound, multiple function tools having foldable and/or retractable tools are known in the art. Such tools may be pivoted into and out of a predetermined channel within at least one handle of the combination tool for selective use. For example, U.S. Pat. No. 4,238,862 to Leatherman describes a pocket multiple tool having an initially folded compact shape which folds out to produce a pair of pliers as well as a nail file, miniature scissors, a permanently magnetized Phillips-type screwdriver, a bottle opener, and small and medium screwdriver bits. Also, U.S. Pat. No. 4,854,045 to Schaub describes a modular pocketknife having electronic components such as a display and entry keyboards as well as a radio receiver. U.S. Pat. No. 5,313,376 to McIntosh has a multipurpose knife with an attachable flashlight. Also, "SWISS ARMY" knives are available, for example, through catalog sales such as "NORM THOMPSON" which have a combination of golf tools, knife, bottle opener, screwdriver, and removable tweezers and toothpick.

However, although combination tools may provide a variety of different implements, the user is generally limited by the tools that are available from a given combination tool for a primary purpose of the tool. For instance, many of such compound, multiple function tools are general purpose tools, primarily adapted for non-business travel, such as camping and hiking. For example, cutting implements and eating implements are typically provided such as knives and can openers.

Heretofore, many combination tools do not have the appropriate tools for use by business travellers, and in particular to address the specific needs which may occur to the everyday business person.

Further, a business traveller may require such business-oriented implements, but may not have the space on one's person to carry many of such implements. Miniature versions of individual business-oriented implements have the deficiencies described above; that is, such miniature versions may be easy to misplace or lose, and combinations of individual implements may be unwieldy.

Accordingly, such business-oriented tools must be of sufficiently compact and reduced size to fit into a briefcase and/or other business travel accessories, such as a purse, a travelbag, a pocket, a glove compartment of a vehicle, a pouch worn about one's waist or other portions of the body, etc.

Heretofore, combination tools have not provided such combinations of business-oriented tools in a compact form for carrying within such business travel accessories.

SUMMARY OF THE INVENTION

It is recognized herein that, for many diverse business-oriented travel needs, a multiple function combination tool may be implemented which provides the versatility of use for business travel purposes, and which has a compact and reduced size to fit within a briefcase and/or other business travel accessories.

A multiple function combination business travel tool is disclosed which combines a plurality of individual business-oriented implements in a single compact and reduced configuration. The business travel tool (hereinafter referenced as a "briefcase tool" for the sake of simplicity but not for purposes of limitation) of the present invention preferably includes a flashlight, a pen, a slot for storing the pen, and a plurality of deployable implements. Each of the deployable implements is disposed in an implement channel and mounted on a respective implement axle for deployment by rotation about the respective implement axle to a selectable angular orientation relative to the implement channel. The plurality of deployable implements includes, but is not limited to, a cutting blade, a cap lifter, a Phillips-type screwdriver, and a nail file. The briefcase tool also preferably includes a pair of scissors and a flashlight. The flashlight preferably is provided in the scale of the tool (the wide side forming the protective housing of the tool) to permit the provision of a reflector and lens larger than those capable of being provided along the narrow sides or ends of the tool. Additionally, a clock may be provided. Preferably, the clock is a digital alarm clock which may be programmed by the user, such as for use on overnight business travel. A plurality of removable implements capable of being completely removed from an additional implement channel may also be provided. Such removable implements include, but are not limited to, a set of tweezers and a toothpick.

In one embodiment, the scissors are arranged and formed such that the tool unit itself forms the scissors handles. More particularly, the tool includes a first handle having a first implement channel and a first scissor channel, and a second handle having a second implement channel and a second scissor channel. First and second scissor blades are mounted to the first and second handles, respectively, by first and second axles, respectively. A scissor fulcrum axle rotatably mounts the first scissor blade to the second scissor blade. The first and second scissor blades are deployably disposed within the first and second scissor channels, respectively, in an undeployed configuration. The deployment of the first and second scissor blades by rotation thereof about the first and second axles, respectively, forms scissors with the first and second handles being handles thereof. Deployable implements preferably are disposed in the first implement channel of the first handle and are mounted on a respective implement axle for deployment by rotation about the respective implement axle to a selectable angular orientation relative to the first implement channel. Removable deployable instruments and a clock preferably are provided on the second handle. A flashlight preferably is provided in a widened portion of the scale of the first handle.

BRIEF DESCRIPTION OF THE DRAWINGS

The features and advantages of the disclosed multiple function combination business travel tool are readily apparent and are to be understood by referring to the following detailed description of the preferred embodiments of the present invention, taken in conjunction with the accompanying drawings, in which.

DETAILED DESCRIPTION OF THE PREFERRED EMBODIMENTS

Referring in specific detail to the drawings, with common reference numbers identifying similar or identical elements, steps, and features, the present invention relates to a multiple function combination business travel tool which, in an initial self-contained configuration is readily carryable in business travel accessories, such as a briefcase, a purse, a travelbag, a pocket, a glove compartment of a vehicle, a pouch worn about one's waist or other portions of the body, etc. The business travel tool of the present invention, hereinafter referenced as a briefcase tool for the sake of simplicity, but not for the purposes of limitation, includes such tools as would be desired by an average business person, particularly during travel. For instance, the briefcase tool of the present invention includes a variety of implements such as a blade, screwdrivers (both Phillips head and flathead), a cap lifter/bottle opener, scissors, a nail file, tweezers, a toothpick, and a pen. Additionally, a flashlight is provided. Preferably, the flashlight is designed and arranged to provide maximum illumination. A clock device, most preferably an alarm clock, may also be provided. Such elements may be arranged in a variety of manners in accordance with the principles of the present invention, illustrative but non-limiting examples being described herein.

FIGS. 1–4 illustrate briefcase tool 10 of the present invention in front, first side, rear, and second side views, respectively. Tool 10 includes a first portion 12 having a generally elongated shape for accommodating a flashlight, a pen, a knife, a cap lifter (bottle opener)/slot screwdriver (on the free end of the cap lifter), a Phillips screwdriver/eyeglass repair combination implement, and a nail file/flathead screwdriver (on the free end of the nail file) combination implement. A second portion 14 has a generally blunt shape which accommodates a clock, a removable toothpick, and a pair of tweezers. A pair of scissors are disposed within tool 10 with each scissor blade being mounted on a respective one of portions 12, 14.

Figure 2:
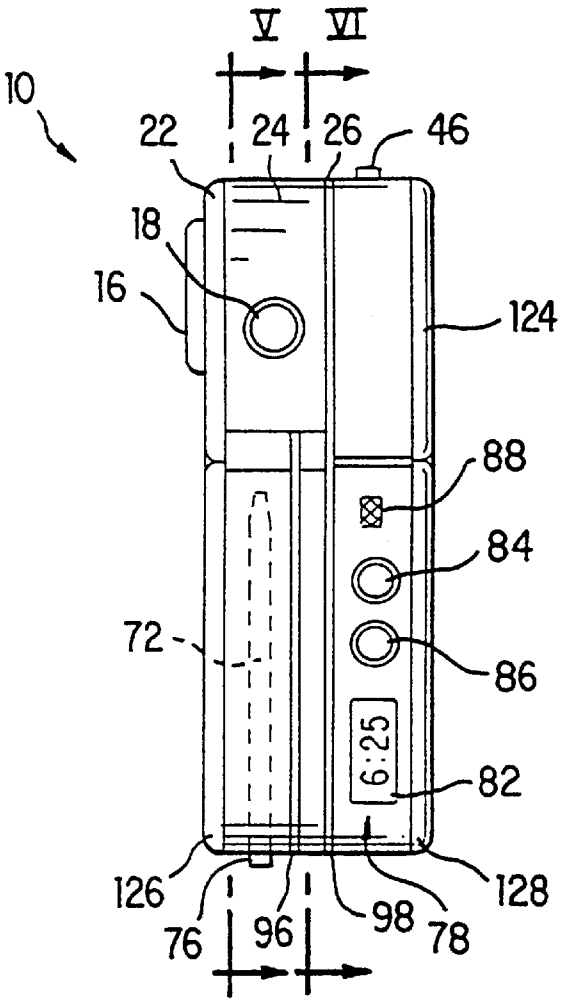
FIG. 2 is a side elevational view showing a first side of the tool of FIG. 1.
Figure 1:
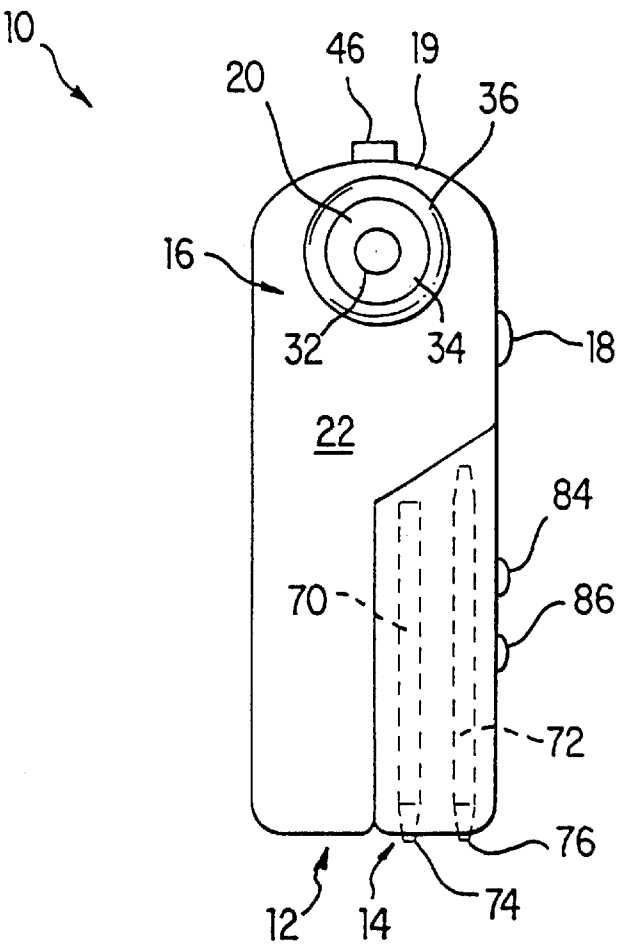
FIG. 1 is a front elevational view of a tool formed in accordance with the principles of the present invention.
Figure 3:
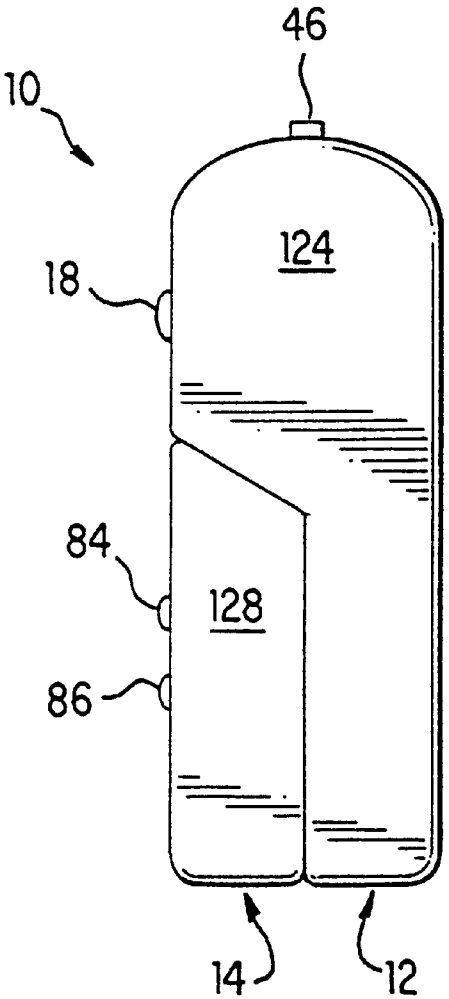
FIG. 3 is a rear elevational view of the tool of FIG. 1.

As shown in FIGS. 1–4, flashlight 16 and an associated flashlight actuator 18 are mounted in an upper section of first portion 12. Flashlight actuator 18 may be a pushbutton, a toggle switch, or other activation means for turning flashlight 16 on or off or with a variable brightness. Actuator 18 may automatically return to an off position upon release of pressure against actuator 18, or may remain in an on position once actuated, until pressure is once again applied thereto to cause actuator 18 to return to an off position. Flashlight actuator 18 may also be an indented button which is disposed in a groove extending partially into the interior of a flashlight housing 24, such that the tip of a finger, which is defined herein to include a thumb, may be inserted into the groove to actuate flashlight actuator 18. Alternatively, flashlight actuator 18 may be a planar, touch-sensitive surface such as those used on mouses for computer laptops. By using an indented button or a touch-sensitive surface, flashlight actuator 18 may present no side profile extending from flashlight housing 24, and so there is a lower probability of accidental activation of flashlight 16 due to normal holding by the user or due to frictional contact with other elements such as books and surfaces in a briefcase or other carrying cases. Flashlight actuator 18 may be positioned on the side of tool 10, as shown in FIGS. 1–3, such that a user may hold tool 10 with a thumb positioned on flashlight actuator 18 for activation and deactivation. Alternatively, actuator 18 may be positioned at the end 19 of tool 10 adjacent flashlight 16. Instead of using a finger, the user may utilize a toothpick, such as described herein, or another blunt pointed implement to actuate flashlight actuator 18.

Flashlight 16 may have a lens 20; that is, a generally planar plate or sheet of substantially transparent material which extends through an aperture of a front scale (housing plate) 22 of tool 10. If desired, the focal length of lens 20 may be adjustable to adjust the focus of the light emitted from flashlight 16. Flashlight housing 24 is mounted between front scale 22 and a first intermediate plate 26, with flashlight actuator 18 extending through an aperture in one side of flashlight housing 24, as shown in FIG. 2.

Figure 5:
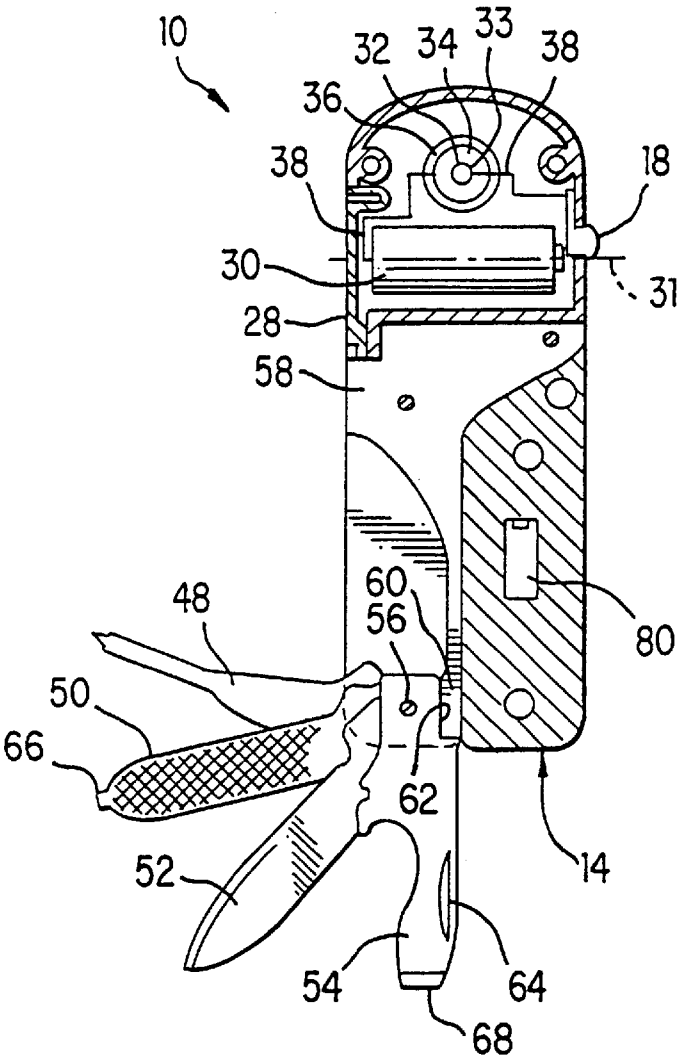
FIG. 5 is a cross-sectional view along line V—V of FIGS. 2 or 4 with individual implements of the tool in a deployed configuration.

A battery hatch 28, shown in FIG. 5, is provided to permit replacement of a battery 30 for powering flashlight 16. Tool 10 and flashlight housing 24 have an interior space therein for accommodating battery 30, and battery hatch 28 is of sufficient width to permit replacement of battery 30. For example, battery 30 may be an N size battery providing about 1.5 V DC to power flashlight 16, or alternatively may be multiple energy cells such as a No. 357 type battery cell. Accordingly, appropriate instructions accompanying tool 10 and/or indicia etched or labeled on tool 10, such as on battery hatch 28, may indicate requisite battery sizes, types, voltages, and/or insertion orientation.

As shown in FIG. 5, the remaining components of flashlight 16 such as replaceable battery 30, bulb 32 positioned in a reflector 34, a bezel 36 for mounting the reflector 34 in front scale 22, and electrical connections 38 are disposed within flashlight housing 24. As will be appreciated with reference to FIG. 5, flashlight 16 is positioned in front scale 22 and electrical connections 38 are configured such that longitudinal axis 31 of battery 30 is perpendicular to longitudinal axis 33 of bulb 32. Such orientation of flashlight 16 permits a larger lens 22, bulb 32, and reflector 34 to be used than would be possible if flashlight 16 were positioned along end 19 of tool 10. Moreover, such orientation of electrical connections 38 permit battery 30 to occupy as little space as possible along the length of tool 10 to permit maximum space for implements to be housed therein as described below.

Battery hatch 28 may include a conductive plate for contacting electrical connections 38 when battery hatch 28 is coupled to flashlight housing 24, such that the ends of battery 30 contact the conductive plate and electrical connections 38. Accordingly, the components of flashlight 16 create a circuit in order to respond to actuation of flashlight actuator 18 to provide or to remove electrical contact and circuit pathways between battery 30 and bulb 32.

Figure 6:
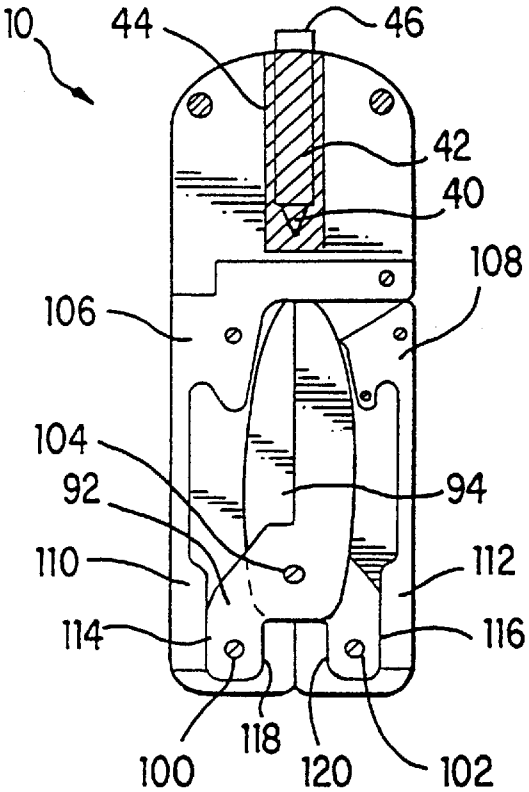
FIG. 6 is a cross-sectional view of along lines VI—VI of FIGS. 2 or 4 with a pair of scissors in a folded configuration.

First portion 12 preferably also includes a writing implement disposed in an upper section of first portion 12, as shown in FIG. 6. In an illustrative embodiment, the writing implement may be a ballpoint pen 40 having an ink cartridge 42 removably stored in a slot 44 at end 19 of tool 10, and with an end 46 of the ink cartridge 42 extending slightly beyond end 19 of first portion 12 to allow the user to grasp and remove pen 40. In one embodiment, pen 40 may be used separately and independently from tool 10; that is, the user may grasp and write with pen 40 only, and tool 10 may then be set side and unused. Alternatively, end 46 may also include means for attaching end 46 to slot 44 after ink cartridge 42 is turned 180° to have the writing end of pen 40 extend away from tool 10 during writing. For example, end 46 and slot 44 may have screw threads for permitting end 46 to be screwed into and secured within slot 44 such that the user may holds tool 10 with pen 40 extending therefrom during writing. Tool 10 thus functions as an extension of the gripping portion of the writing instrument. The attaching means may also be a frictional engagement, such that end 46 may be squeezed in, popped in, or locked in a corresponding surface of slot 44 in a removably secured configuration during writing.

Figure 4:
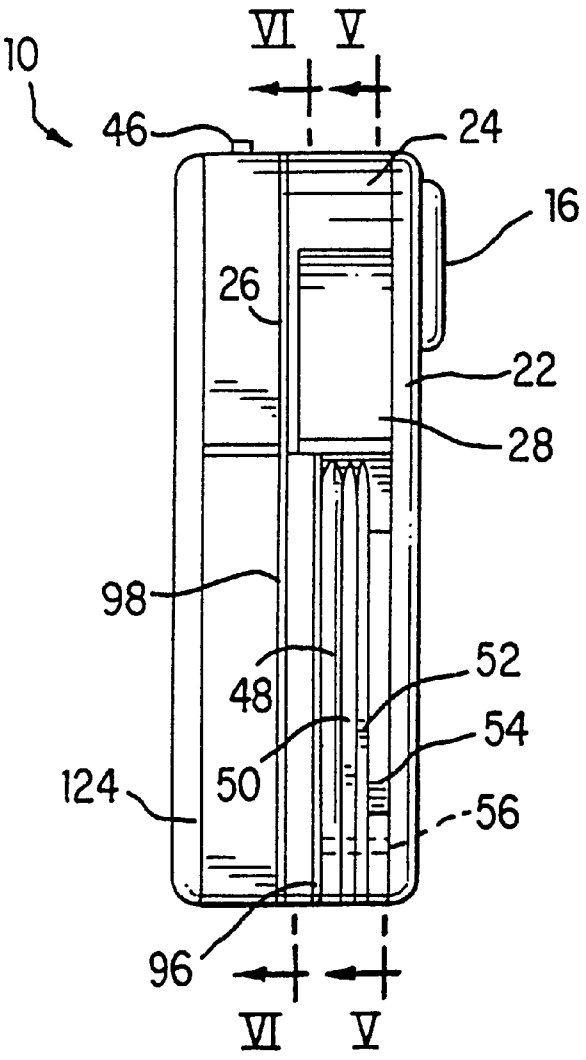
FIG. 4 is a second side elevational view showing a second side, opposite first side, of the tool of FIG. 1.

In the illustrative embodiment shown in FIGS. 2 and 4, pen 40 is shown with the writing tip oriented inward toward the interior of tool 10. In alternative embodiments, the writing tip may be oriented outward, such that pen 40 and the writing tip may be extended from tool 10, with an end 46 having a detent or other anchoring engagements to prevent the pen 40 from being totally removed from tool 10, and so that pen 40 may be retracted back into tool 10 during non-use. In another alternative embodiment, pen 40 and ink cartridge 42 may be hinged by, for example, an axle within the upper section of first portion 12, such that rotation of pen 40 about the hinge deploys pen 40 for use, and re-inserts pen 40 back into first portion 12 during non-use.

It is understood that the writing implement of tool 10 may be or may also include a pencil, a marker, a rod of chalk, or other writing devices. Alternatively, the writing implement of tool 10 may be replaced with or be incorporated with other useful business-related implements; for example, a pointer which may be telescopically extendable for use during business presentations; a laser pointer for business presentations which may be powered by the battery of flashlight 16; an eraser such as an extendable rubber-like rod for use with a writing implement; a tube of glue/paste; a tube of liquid correction fluid; and even a dispenser for correction tape.

Referring to FIGS. 4–5, a lower section of first portion 12 includes a plurality of deployable, pull-out implements, which may include, but are not limited to, a Phillips head screwdriver 48, a nail file 50, a blade 52, and a cap lifter 54. Such components of the disclosed tool 10 are, in a preferred embodiment, not magnetized, and further may be composed of non-magnetic materials such as hardened ceramics in order to be carried in briefcases and other carrying accessories which may include magnetically sensitive materials such as computer disks, cassette tapes, dictaphone tapes, and credit cards which business travellers typically carry. The proximity of the disclosed tool 10 to such magnetically sensitive materials typically requires that the disclosed tool 10 not have any magnetizing and/or demagnetizing influence on surrounding items in a briefcase or other carrying accessories.

Each of implements 48–54 is mounted on at least one axle in the first portion 12 so as to be rotated thereabout to any angular orientation between, for example, 0° and 180°. In the illustrative embodiment shown in FIGS. 4–5, implements 48–54 share a common axle 56 extending through aligned apertures of implements 48–54.

Each of implements 48–54 is associated with a respective spring, such as spring 58, which is mounted in first portion 12, and which has a generally curved recess forming an implement channel for accommodating the respective implements in any angular orientation, and which may also generally match the shape of each of implements 48–54. The elongated portion of spring 58 has an end 60, and spring 58 flexes during rotation of each of a respective one of the implements. Preferably, when a selected implement is rotated to a predetermined deployed position, such as the 180° position of cap lifter 54 shown in FIG. 5, the respective end 60 of spring 58 engages a corresponding detent 62 of the implement to removably lock the implement into the deployed position.

To reposition each respective implement, for example, to rotate the implement back into the fully retracted position as shown in FIGS. 1–4, the user rotates the implement and provides a sufficient force to flex spring 58 and to disengage end 60 from the respective detent 62.

As with other combination tools, each of implements 48–54 may include a recess 64 to allow the user to select and at least initially rotate the implement out from the fully retracted position, such as shown in FIGS. 1–4. Implements 48–54 have associated widths and positions of each respective recess 64 such that implements 48–54, or alternatively respective recesses 64, are generally staggered to allow ease of access to a selected implement, such that the remaining implements do not block the user from grasping and deploying the selected implement.

Each of implements 48–54 may have multiple functions and features. For example, Phillips head screwdriver 48 may be a micro-Phillips head screwdriver dimensioned for use in repairing watches, such as watchbands which may come loose; as well as eyeglass frames, which typically use screw engagements between portions of the frames. Nail file 50 and/or blade 52 may include a tip 66 shaped and dimensioned to act as a small flathead screwdriver, which may also be used in watch and eyeglass repair. Cap lifter 54 may also include a relatively large tip 68 configured to function as a slot and/or flathead screwdriver. Thus, by including a plurality of screwdriver sizes and shapes, implements 48–54 provide greater versatility in use for diverse applications, including such tasks typically associated with business travel, such as eyeglass repair, grooming with nail file 50, and opening beverage bottles with cap lifter 54.

Referring to FIGS. 1–2, second portion 14 of tool 10 includes tweezers 70 and a toothpick 72 removably disposed within respective slots in second portion 14. Tweezers 70 and toothpick 72 may be secured by a frictional fitting of the sides and ends thereof with the walls of the respective slots Ends 74, 76 of the tweezers 70 and toothpick 72, respectively, may extend slightly beyond the surface of second portion 14 to allow a user to grasp and remove the selected implement, for example, for grooming purposes during business travel.

Second portion 14 preferably also includes a clock device 78, such as the digital clock in the illustrative embodiment of FIG. 2. Clock device 78 preferably is provided along a side of tool 10, as shown in FIG. 2, so that tool 10 is stable when rested on a surface, such as a bedside night table, to view clock device 78. However, clock device 78 maybe located along a scale of tool 10 instead. A battery powered clock 78, as shown in exemplary tool 10, is self-contained by including a clock battery therein, and so, in a preferred embodiment, is not connected to battery 30 of flashlight 16 or outside power sources. Thus, continuous power to clock 78 is provided to maintain the correct time without power instabilities, such as power fluctuations and drains from flashlight 16, and interruptions during battery replacement procedures. Typically, clocks 78 may use power cells which may last over three years without replacement. To facilitate battery replacement when necessary, second portion 14 may include an opening, such as a clock battery hatch 80, to permit such replacement as needed.

As shown in FIG. 2, clock 78 includes a digital clock face 82, which may be in the form of a liquid crystal display (LCD), or alternatively a set of light emitting diodes (LEDs). In other alternative embodiments, the clock device may have an analog face; that is, hour and minute hands, but may be battery-powered.

Referring to FIGS. 1–3, clock 78 preferably also includes a plurality of clock actuators 84–86 for implementing time setting functions, mode setting functions, alarms, etc. For example, clock 78 may also be an alarm clock, and so includes a speaker for generating an alarm tone. In an illustrative embodiment, the speaker may be associated with a speaker aperture 88 for permitting the alarm audio signals to be broadcast with sufficient volume. Additional buttons may be provided, as desired, for additional settings.

As described above for flashlight actuator 18, clock actuators 84–86 may include a pushbutton, a toggle switch, or other activation means, such as an indented button or groove, as well as planar, touch-sensitive surfaces to minimize accidental modifications of the time settings of clock 78. A toothpick, as described herein, or other blunt pointed implement may also or alternatively be used to actuate clock actuators 84–86.

Figure 7:
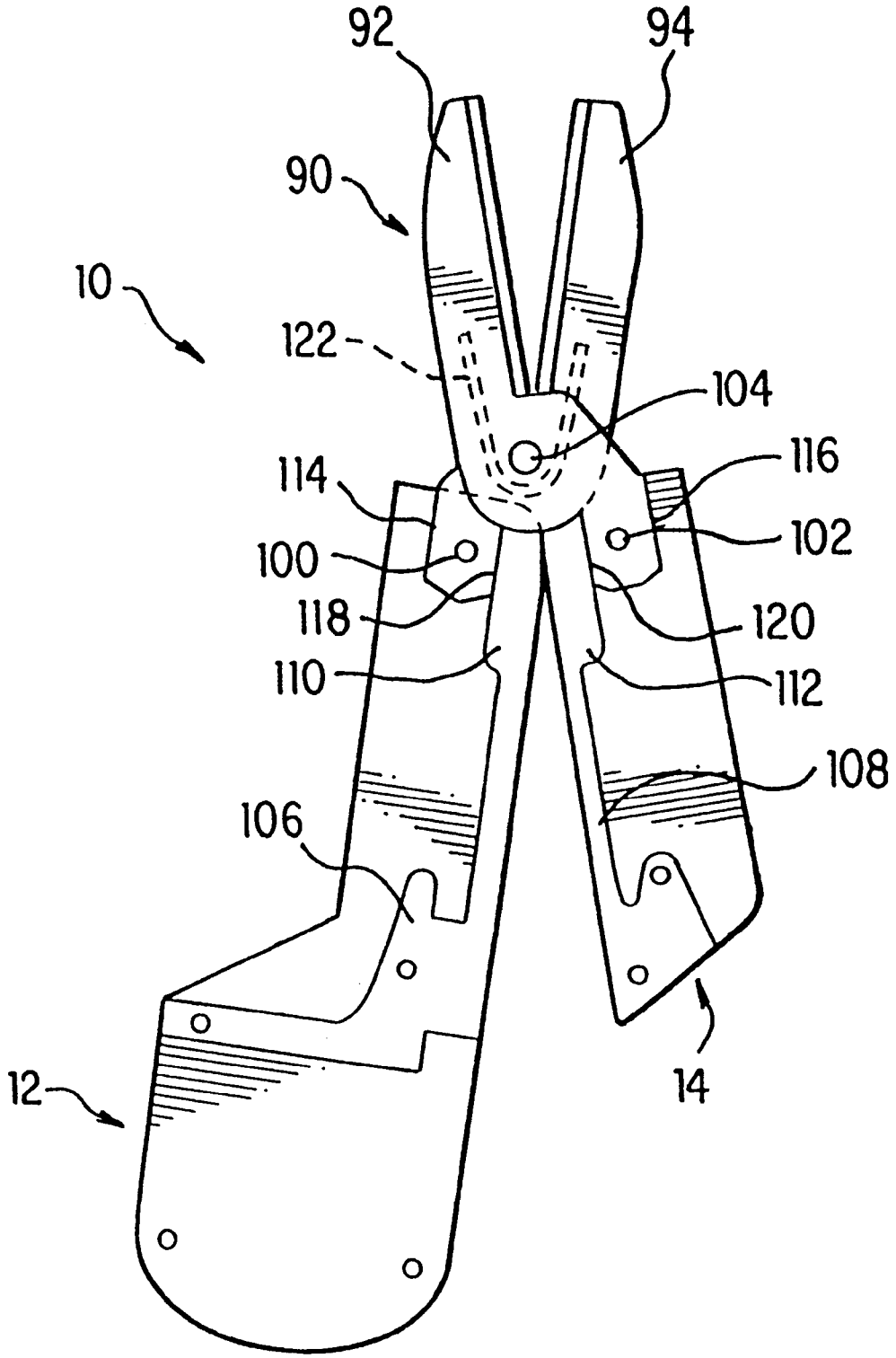
FIG. 7 is a cross-sectional view similar to that of FIG. 6 but with the scissors thereof in a deployed configuration.
Figure 9:
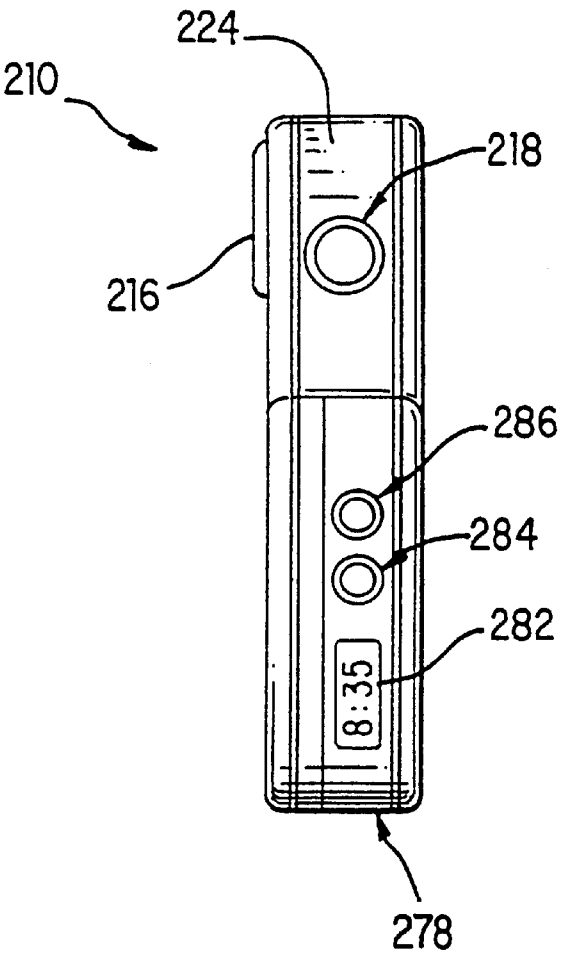
FIGS. 8–11 are an alternative embodiment of a tool formed in accordance with the principles of the present invention.
Figure 8:
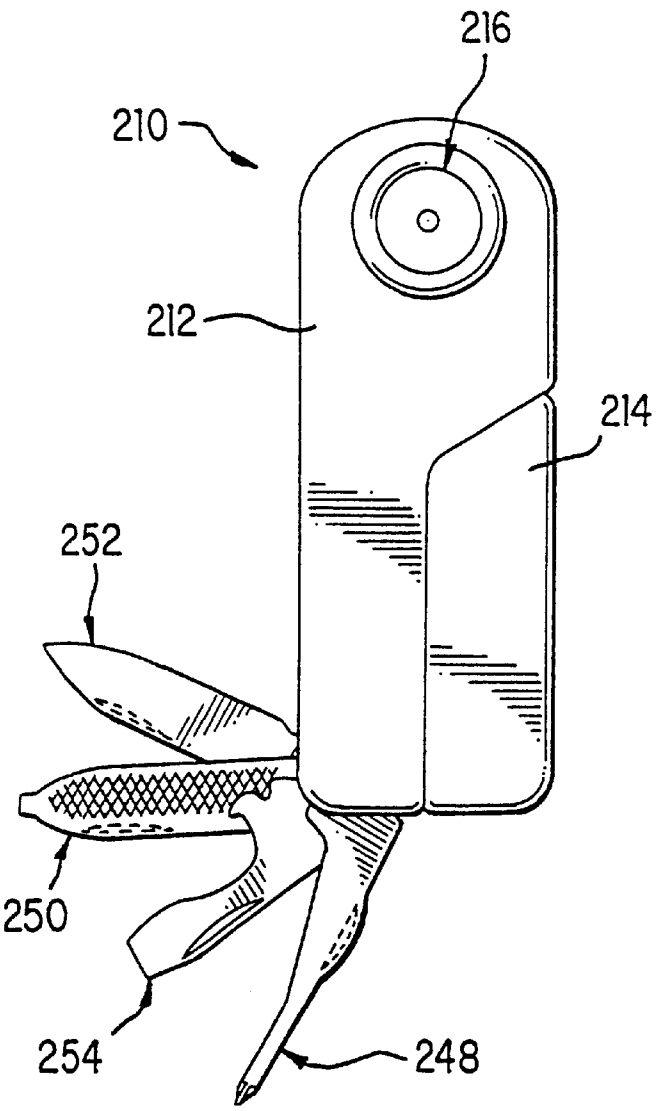
Figure 11:
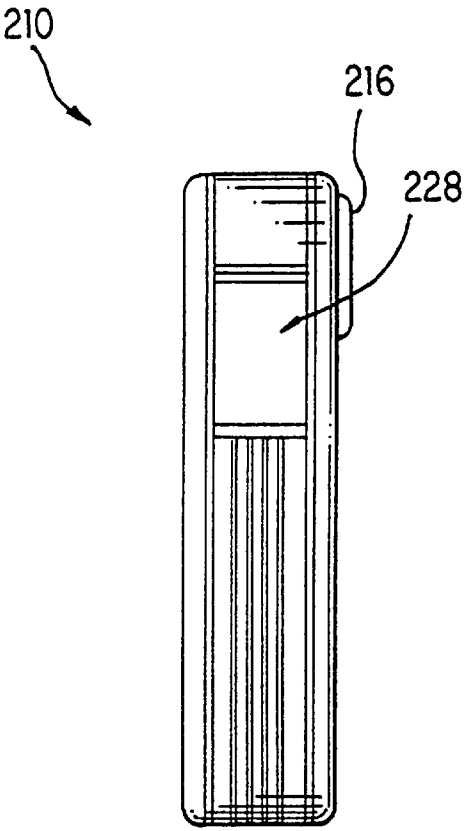
Figure 10:
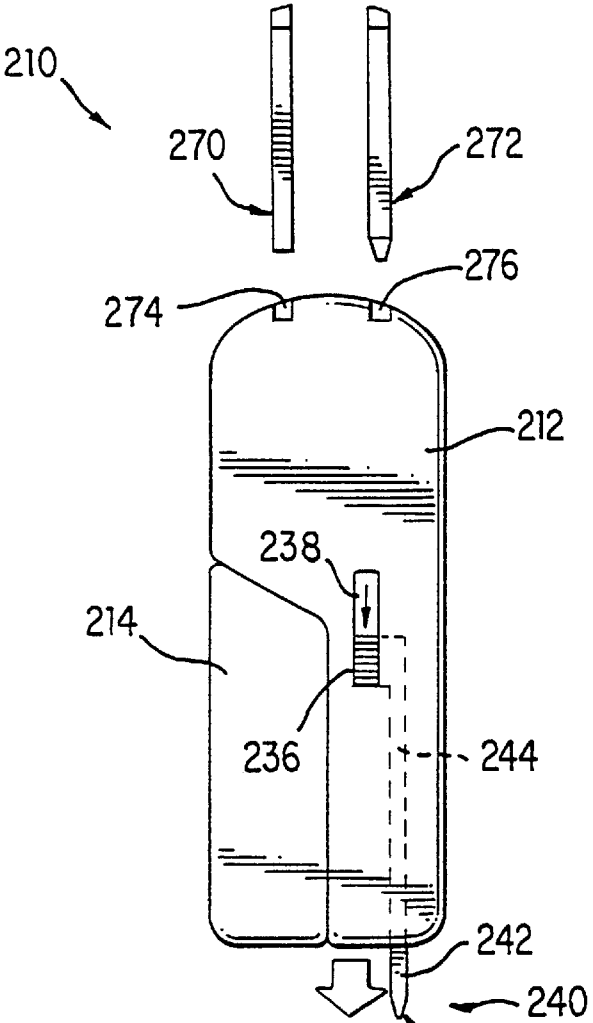

As shown in FIGS. 6–7, tool 10 also includes scissors 90 which may be reconfigured from a folded position, as shown in FIG. 6, to a deployed position, as shown in FIG. 7. Scissors 90 include a pair of blades 92, 94 which are disposed between a second intermediate plate 96 and a third intermediate plate 98 (shown in FIG. 2) which divide second portion 14 of tool 10 into a front section, in which tweezers 70 and toothpick 72 are disposed; a rear section, which includes clock 78; and an intermediate section for storing blades 92, 94 in a scissor channel formed by the intermediate plates 96, 98.

Each blade 92, 94 is mounted on a respective blade axle 100, 102 to first portion 12 and second portion 14, respectively. When scissors 90 are deployed, as shown in FIG. 7, portions 12, 14 of tool 10 function as the handles of scissors 90. The scissor fulcrum axle 104 couples blades 92, 94 together, and also effectively connects portions 12 and 14 together.

Each of blades 92, 94 is associated with a respective spring 106, 108 of portions 12, 14, respectively, with each spring 106, 108 shaped and dimensioned to accommodate blades 92, 94, as shown in FIG. 6. Each spring 106, 108 includes spring ends 110, 112, respectively, for engaging surfaces 114–120 of blades 92, 94. In particular, the outer surfaces 114, 116 of blades 92, 94 are generally planar for resting against the generally planar spring ends 110, 112. The restorative force of springs 106, 108 causes spring ends 110, 112 to secure outer surfaces 114, 116 from moving, that is, rotating when tool 10 is in the closed configuration shown in FIG. 6.

During deployment, the user rotates portions 12, 14 about respective blade axles 100, 102 so as to overcome the restorative force of springs 106, 108 to disengage spring ends 110, 112 from outer surfaces 114, 116. When portions 12, 14 are sufficiently rotated to the position shown in FIG. 7, spring ends 110, 112 engage inner surfaces 118, 120 of blades 92, 94. The restorative force of springs 106, 108 then secures inner surfaces 118, 120 from moving, that is, rotating, when tool 10 is in the deployed open configuration shown in FIG. 7.

Similarly, to return tool 10 to the closed position of FIG. 6, the user rotates portions 12, 14 about blade axles 100, 102 with sufficient force to overcome the restorative forces of springs 106, 108, and so to disengage spring ends 110, 112 from inner surfaces 118, 120 and to engage outer surfaces 114, 116.

The disclosed tool 10 may also include a bias spring 122 mounted in corresponding spring mounting channels in each of blades 92, 94, for biasing blades 92, 94 apart when scissors 90 are deployed. By biasing blades 92, 94, scissors 90 are deployed with portions 12, 14 having an angular orientation attaining a maximum rest angle to have blades 92, 94 open for use. As shown in FIG. 7, the maximum rest angle may be about 15°. During use, the user overcomes the restorative force of bias spring 122 to bring portions 12 and 14 together and thus blades 92 and 94 together. In alternative embodiments, bias spring 122 may be omitted.

As shown in FIGS. 1–4, first portion 12 includes a front scale 22 as well as a back scale 124, for example, for enclosing the components therebetween. Similarly, second portion 14 includes a front scale 126 and a back scale 128. For the surfaces of scales 22 and 124–128 which face outward, each of such outward surfaces may have a smooth finish. Alternatively, the surfaces may have a granular finish for providing friction with the hands of the user holding and using tool 10. In addition, indicia such as a trademark, a logo, patent marking information, and other product indicators may be placed on such outward surfaces. As shown in the embodiment of FIGS. 13–17, and as described in further detail below, a soft material with a preferably high coefficient of friction may be overmolded over scales 22, 124, 126, 128 to improve grip of tool 10 and to increase friction so that tool 10 does not slip when placed on a surface, such as for viewing of clock 78.

In an alternative embodiment shown in FIGS. 8–11, the disclosed tool 210 includes a first portion 212 and a second portion 214. First portion 212 includes a flashlight 216 with a corresponding flashlight actuator 218 disposed in a flashlight housing 224, such as described above. A battery hatch 228 is provided in flashlight housing 224 to permit replacement of a battery for operating flashlight 216.

Tool 210 further includes a pen actuator such as a sliding button 236 capable of sliding within a pen actuator slot 238 to deploy or to retract a pen 240 disposed in first portion 212 and connected to sliding button 236. Pen 240 includes a cartridge 242 which is slidably disposed within a slot 244 in first portion 212, such that the writing end or tip 246 of pen 240 may be fully extended out of or fully retracted into first portion 212.

First portion 212 also includes deployable implements such as a Phillips screwdriver 248, a nail file 250, a cutting blade implement 252, and a cap lifter 254, which may be selectively deployed and selectively oriented through use of various springs and detents, as described above with reference to FIGS. 1–7.

Tweezers 270 and toothpick 272 of tool 210 are removably disposed in respective slots 274, 276, in first portion 212. Accordingly, except for a pair of scissors 290, shown in FIG. 12, which are mounted to both of portions 212, 214, second portion 214 includes only clock 278 having clock face 282 and actuators 284, 286 along a side, while all of the deployable and removable implements are provided in first portion 212.

Figure 12:
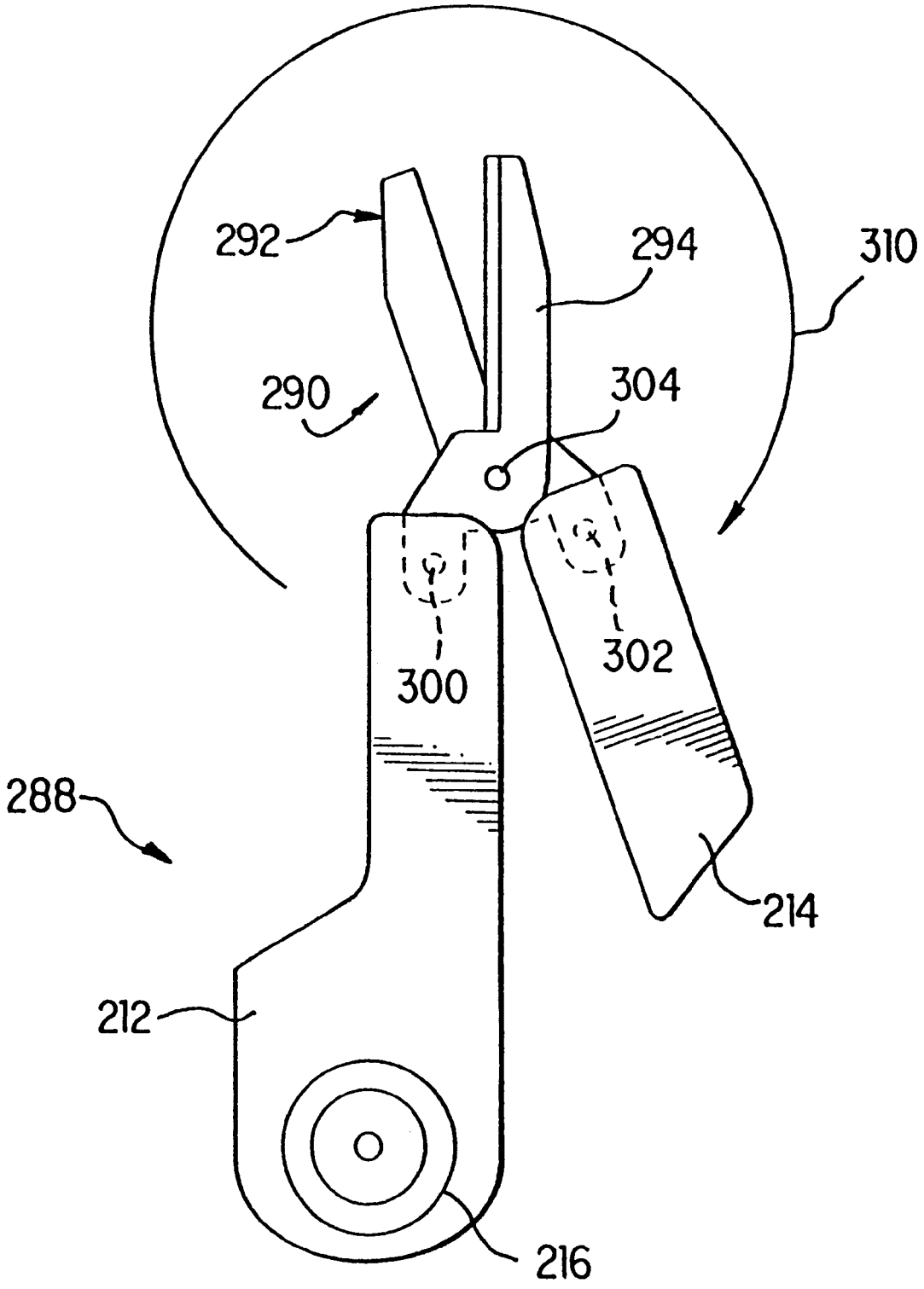
FIG. 12 is an elevational view of the tool of FIGS. 8–11 with the scissors thereof in a deployed configuration.

As shown in FIG. 12, tool 210 may be reconfigured in a fully deployed configuration 288 with a pair of scissors 290 having portions 212, 214 functioning as scissors handles. Scissors 290 includes blades 292, 294 mounted on axles 300, 302, respectively, of portions 212, 214, respectively. Blades 292, 294 are pivotally mounted to each other via fulcrum axle 304. The reconfiguration of tool 210 is performed by rotating first portion 212 about axle 300 as well as rotating second portion 214 about axle 302 such that second portion 214 rotates a predetermined angular arc, such as about 340°, in the direction of arrow 310 in a relative motion about the fulcrum axle 304. Alternatively, both portions 212, 214 may be moved and rotated accordingly to provide relative rotation of second portion 214 away from first portion 212 to attain the deployed configuration 288.

Figure 13:
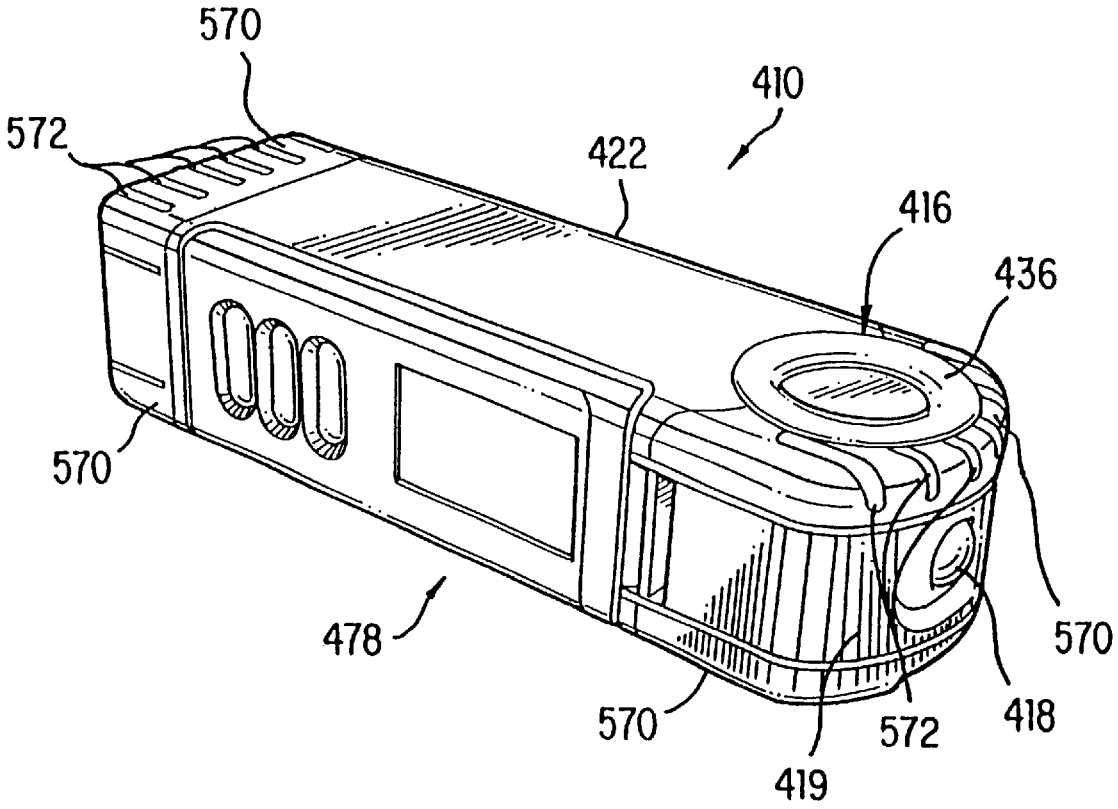
FIG. 13 is a perspective of another alternative embodiment of a tool formed in accordance with the principles of the present invention.
Figure 14:
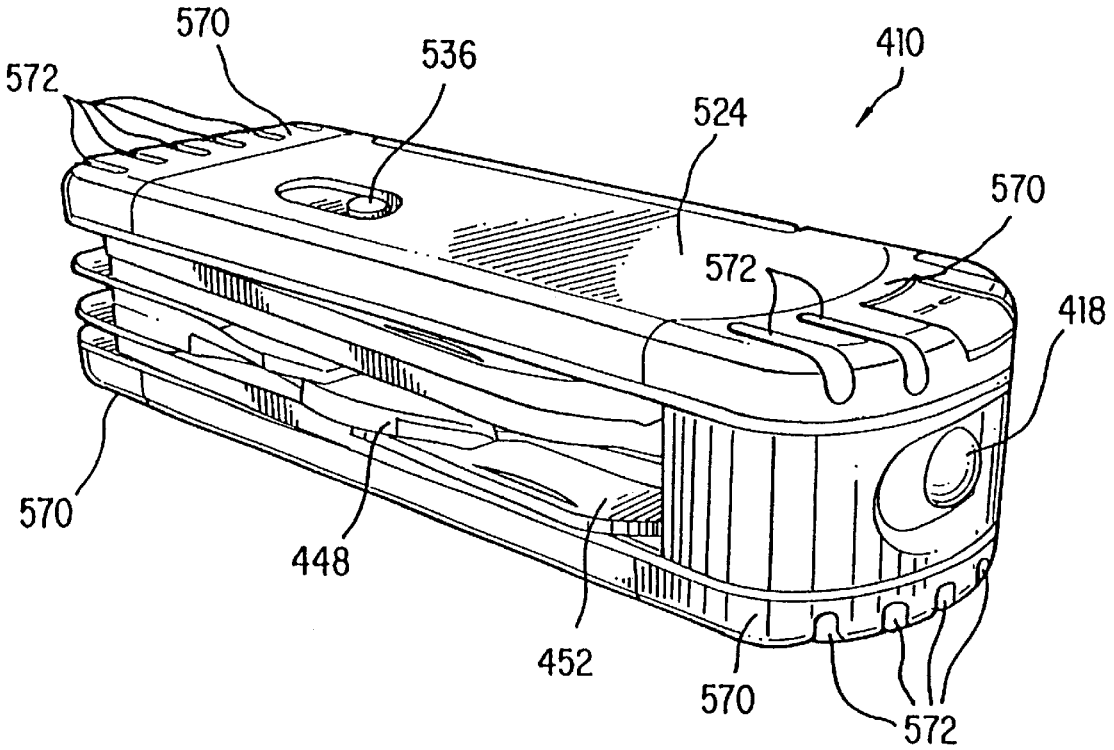
FIG. 14 is a perspective view of the opposite side of the tool of FIG. 13.

A simplified tool 410, illustrated in FIGS. 13–17, does not include a scissors which utilizes the portions of the tool as handles as in the embodiments of FIGS. 1–12. Instead, tool 410 is similar to standard pocket tools and has only one front scale 422 and only one back scale 524, as may be appreciated with reference to FIGS. 13–15. However, as shown in FIGS. 13 and 14, like tool 10, tool 410 also includes a flashlight 416 in front scale 422, a clock 478 along a side of the tool, and a plurality of implements stored in a side opposite clock 478. It will be appreciated that elements of tool 410 similar to elements of tool 10 have the same reference elements increased by 400.

Like flashlight 16 of tool 10, a flashlight actuator 418 preferably is provided in end 419 of tool 410 and may be in any desired form as described above with reference to actuator 18. Also like flashlight 16, flashlight 416 also includes a lens 420, a flashlight housing 424, a bulb 432, a reflector 434, a bezel 436, and electrical connections 438 for coupling actuator 418 to a battery 430 to actuate flashlight 416 (shown, assembled, in FIG. 16), as may be appreciated with reference to the exploded view of FIG. 15. It will be appreciated that, as described above, such orientation of flashlight 416 permits a wider diffusion of light than would be permitted if flashlight 416 were provided in end 419.

Figure 15:
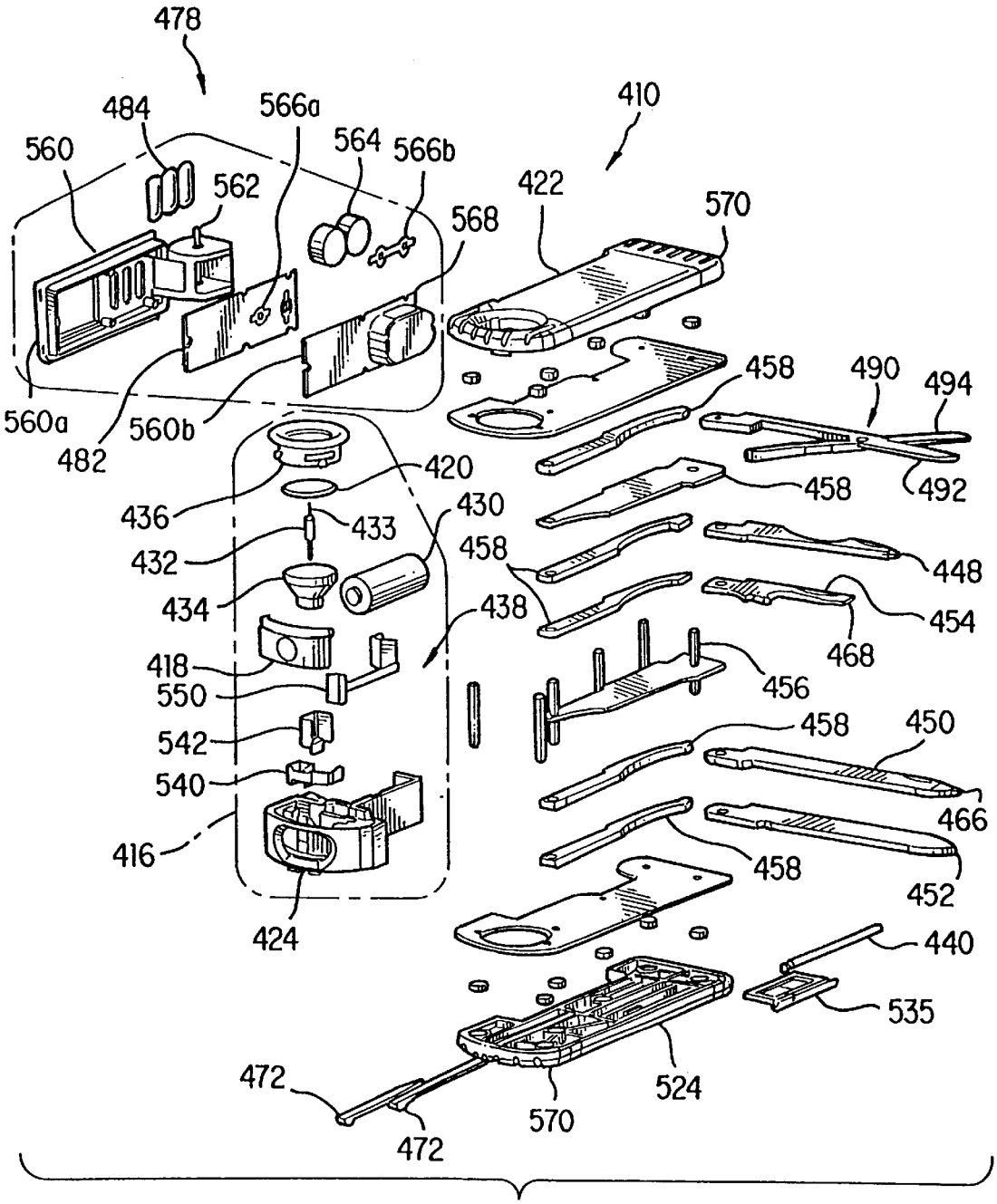
FIG. 15 is an exploded view of the tool of FIG. 13.
Figure 16:
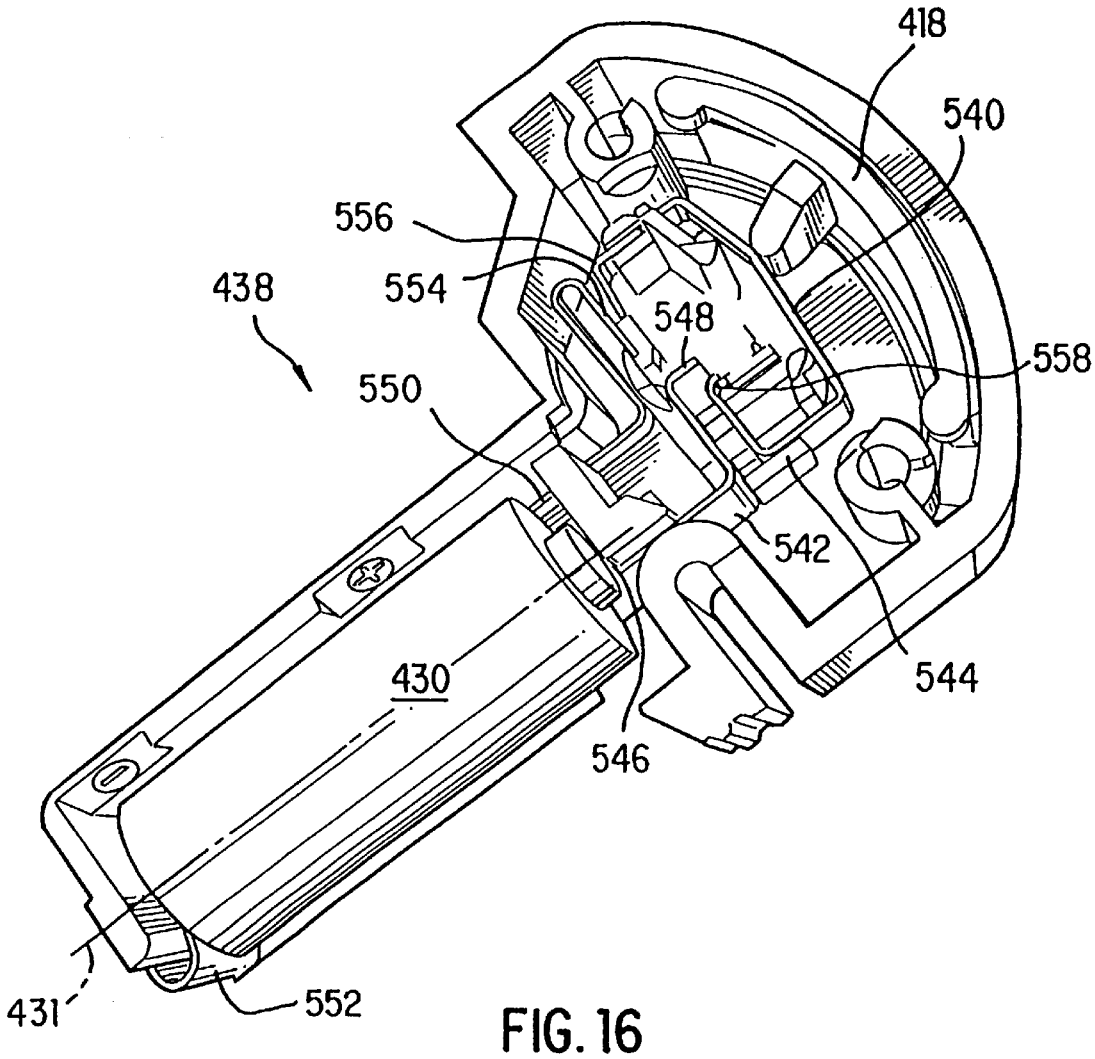
FIG. 16 is a perspective view of the electrical connections for the flashlight of the tool of FIG. 13.

An exemplary arrangement of elements of electrical connections 438 is shown in FIGS. 15 and 16. Electrical connections 438 preferably includes a first lead 540 positioned for movement with movement of flashlight actuator 418. Movement of first lead 540 causes reciprocation of second lead 542 via block 544 so that battery contact end 546 of second lead 542 is pushed into contact with a first end of battery 430 (such as the positive end, as shown in FIG. 16). The opposite end of second lead 542 forms a bulb contact end 548 coupled to a first electrical contact (such as contact wires, as shown in FIG. 15) of bulb 432 to provide a first electrical connection thereto. The second end of battery 430 (the negative end in the embodiment of FIG. 16) and a second electrical contact of bulb 432 are electrically coupled via first lead 540 and third lead 550. In particular, a battery contact end 552 of third lead 550 is preferably in constant contact with the other end of battery 430. An electrical connection end 554 of third lead 550 is in electrical contact with an electrical connection end 556 of first lead 540, and a bulb contact end 558 of first lead 540 contacts the second electrical contact of bulb 432 to electrically couple the second end of battery 430 to a second electrical contact of bulb 432.

Such arrangement of flashlight 416 and electrical connections 438 permits longitudinal axis 433 of bulb 432 to be perpendicular to longitudinal axis 431 of battery 430, thereby permitting flashlight 416 to be housed in one of scales 422, 524 of tool 410. Accordingly, a larger flashlight then previously provided in prior art pocket tools may be provided in tool 410. It will be appreciated that various modifications to the electrical connections shown in FIGS. 15 and 16 may be made within the scope of the present invention.

Figure 17:
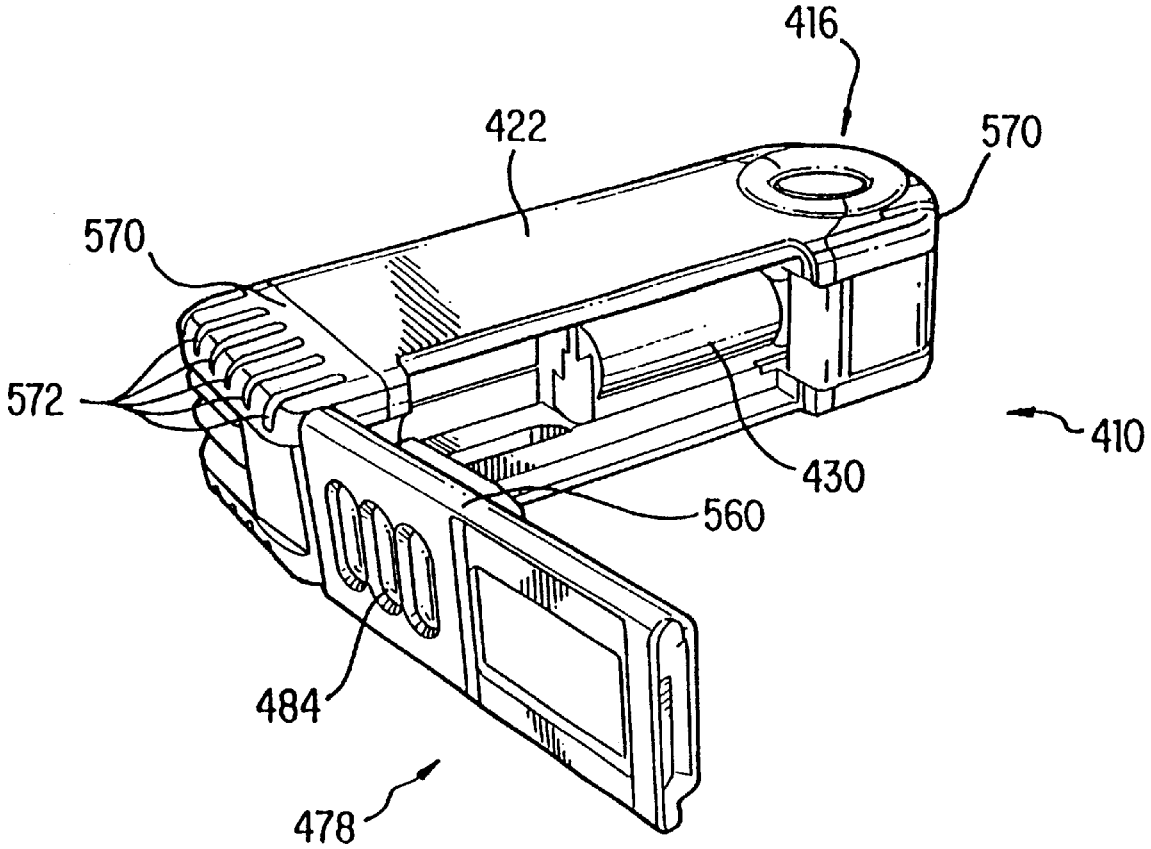
FIG. 17 is a perspective view of the tool of FIG. 13 with the clock housing pivoted open to access the battery housings of the clock and the flashlight.

As may be appreciated with reference to FIG. 17, battery 430 of flashlight 416 preferably is accessible for replacement by pivoting clock housing 560 about pivot axle 562. Thus, the arrangement of battery 430 with battery longitudinal axis 431 substantially parallel to longitudinal axis 411 of tool 410 permits relatively easy replacement of battery 430. Such pivotability of clock housing 560 also permits easy replacement of clock batteries 564 positioned between clock battery leads **566*a* and 566*b* and within battery housing 568**.

As may be appreciated with further reference to FIG. 17, clock 478 includes a clock face or mechanism 482 positioned between first and second portions **560*a* and 560*b* of clock housing 560. Front clock housing portion 560*a* preferably has an aperture through which clock face 482 may be viewed, as well as apertures for clock actuator buttons 484. As many actuator buttons 484 as needed, in the form described above with reference to actuator buttons 84**, may be provided. For example, an actuator button may be provided for each of the following functions: time set, alarm set, alarm on/off.

Moreover, such orientation of battery 430 as described above provides the greatest amount of room for implements to be contained along the side of tool 410 opposite clock 478. Such implements may include the same deployable implements as provided in tool 10, such as a Phillips screwdriver (preferably a micro-Phillips screwdriver) 448, a nail file 450 with a tip 466 formed as a flathead screwdriver or other implement, a cutting blade implement 452 (which alternatively may have a tip formed as a flathead screwdriver or other implement), a cap lifter 454 with a relatively large tip 468 configured to function as a slot and/or flathead screwdriver (or other implement), each pivotably coupled to tool 410 about pivot axle 456. Each implement preferably has a respective spring 458 for biasing the implement into a desired position, as described in further detail above with respect to the implements of tool 10. A scissors 490 may also be pivotably coupled to tool 410, preferably via pivot axle 456. As discussed above, the scissors 490 provided in tool 410 has handles extending from the back ends of respective blades 492, 494 and thus independent of the housing or scales of tool 410. A variety of additional implements as described above with respect to tool 10 may provided on tool 410 as well.

Like tool 10, tool 410 preferably includes removable implements, such as a writing implement 440, tweezers 470, and a toothpick 472, each provided in a respective slot preferably provided in one of scales 422, 524. As shown in FIGS. 14 and 15, writing implement 440 preferably is held in a writing implement holder 535 which is slidably positioned in a writing implement actuator slot. A sliding writing implement actuator 536 extends from writing implement holder 535 through one of scales 422, 524 (in FIG. 14, scale 524) for access by a user. Sliding of writing implement actuator 536 causes writing implement 440 to be extended from tool 410 for use or retracted within the writing implement actuator slot for storage. It will be appreciated that other forms of writing implements, such as those described above with respect to tool 10, may be used instead.

As shown in FIGS. 13, 14, 15 and 17, an overmold 570 may be provided over at least a portion of one or both of scales 422, 524. In a preferred embodiment, scales 422 and 524 are formed from a substantially rigid, durable material, such as a plastics material, suitable for forming a protective shell or housing such as provided by scales 422, 524. Preferably, the material is chemically resistant and water resistant. One such material is acetyl, such as DELRIN®, manufactured by Dupont Company, Polymers of Wilmington, Del. In order to enhance tactile comfort, overmold 570 is preferably formed from a material which is softer than the material of scales 422, 524. Moreover, the material of overmold 570 preferably has a higher coefficient of friction to provide a non-slip surface to tool 410. Thus, when tool 410 is placed on a support surface, slippage of tool 410 is inhibited if not prevented. Such anti-slip property is particularly useful when tool 410 is placed on a surface, such a bedside night table, for viewing clock 478 and, if desired, using the optional alarm feature of clock 478. Preferably, overmold 570 is formed from an elastomeric or rubber material, such as SANTOPRENE®, manufactured by Monsanto, Inc. of St. Louis, Mo. If desired, ridges 572 may be formed along the surface of overmold 570 for additional friction or simply for aesthetic appeal. If only an aesthetic effect from overmold 570 is desired, although the material of overmold 570 should at least have as much durability and chemical and weather resistance as the material of scales 422, 524, any desired material may be used.

It will be appreciated that additional implements may be provided on any of the above-described tools. For instance, a lanyard or keychain may be provided for attachment of keys or other objects thereto. Additionally, a miniature recording device may be provided in any of the above-described tools for recording memos. The length of the memo will vary depending on the memory capacity of the voice chip or other recording device provided to store the memo or message. Other devices deemed to be useful to a business person may be provided as well. For example, other business-oriented features may be incorporated such as a miniature staple, a paper clip storage section and/or a paper clip feeder, a personalized name and address stamp, etc.

While the disclosed multiple function combination business travel tool is particularly shown and described herein with reference to the preferred embodiments, it is to be understood that various modifications in form and detail may be made without departing from the scope and spirit of the present invention. For instance, the ends of the writing implement, tweezers, and toothpick, and the actuators of the flashlight and the clock may extend into shallow recesses in the surfaces of the tool instead of extending out of and beyond the surfaces of the tool as described herein. Moreover, the flashlight may be provided in the back scale instead of the front scale, as described herein, and a different bezel as shown may be provided. Accordingly, modifications such as any examples suggested herein, but not limited thereto, are to be considered within the scope of the present invention.

What is claimed is:

1. A multiple function tool comprising, as a unit:

a plurality of implements;

a flashlight;

a clock;

a first scale forming a first face of said tool; and a second scale forming a second face of said tool;

wherein:

said implements are pivotably coupled to said tool between said first and second scales; and said flashlight has a reflector and is positioned in one of said first and second scales such that said flashlight and said reflector are on a face of said tool.

2. The tool of claim 1, wherein an overmold is provided over at least a portion of at least one of said first and second scales.

3. The tool of claim 1, further comprising a flashlight housing including a compartment for receiving a battery;

wherein:

said flashlight and said battery compartment are oriented with respect to each other such that the longitudinal axis of a bulb provided in said flashlight is perpendicular to the longitudinal axis of a battery provided in said battery compartment.

4. The tool of claim 1, wherein said clock is an alarm clock.

5. The tool of claim 4, wherein said clock is a digital alarm clock.

6. The tool of claim 1, further comprising:

a flashlight housing including a compartment for receiving a battery; and a clock housing in which said clock is housed;

wherein:

said clock housing is pivotably coupled to said tool; and said flashlight housing has an interior portion positioned within said tool behind said clock housing such that pivoting of said clock housing away from said tool permits access to said flashlight housing interior.

7. A multiple function tool comprising:

a first scale;

a second scale;

a plurality of implements stored between said first and second scales;

a clock device coupled to said multiple function tool between said first and second scales, said clock device having a face viewable between said first and second scales such that said multiple function tool is stable when rested on a surface to view said face of said clock device; and a flashlight positioned in one of said first and second scales.

8. The tool of claim 7, wherein said implements are pivotably coupled to said tool.

9. The tool of claim 7, wherein an overmold is provided over at least a portion of at least one of said first and second scales.

10. A multiple function tool comprising:

a first portion having a first implement channel, a first scissor channel, and a first axle;

a second portion having a second implement channel, a second scissor channel, and a second axle;

first and second scissor blades mounted to said first and second portions, respectively, by said first and second axles, respectively;

a scissor fulcrum axle for rotatably mounting said first scissor blade to said second scissor blade;

an electronic device coupled to one of said first and second portions; and a deployable implement disposed in one of said first and second implement channels and mounted on an implement axle for deployment by rotation about said implement axle to a selectable angular orientation relative to said one of said first and second implement channels;

wherein:

said first and second scissor blades are deployably disposed within said first and second scissor channels, respectively in an undeployed configuration; and deployment of said first and second scissor blades by rotation thereof about said first and second axles, respectively, forms scissors with said first and second portions being handles thereof.

11. The tool of claim 10, further comprising a removable implement disposed in the other of said first and second implement channels and capable of being completely removed from said other of said first and second implement channels.

12. The tool of claim 11, wherein said removable implement is at least one of the group consisting of a set of tweezers, a toothpick, and a writing implement.

13. The tool of claim 10, wherein said electronic device comprises a clock device.

14. The tool of claim 13, wherein at least one of said first and second portions includes a battery hatch for replacing a battery for supplying power to said clock device.

15. The tool of claim 10, wherein said first portion includes a spring for applying a restorative force to said deployable implement to lock said deployable implement in one of two predetermined angular orientations with respect to said implement channel.

16. The tool of claim 10, wherein said deployable implement is at least one of the group consisting of a cutting blade, a cap lifter, a Phillips-type screwdriver, a nail file, a flathead screwdriver, and a slot screwdriver.

17. The tool of claim 10, wherein said electronic device comprises a self-contained flashlight.

18. The tool of claim 17, wherein said flashlight includes:

a flashlight actuator arranged for activating and deactivating said flashlight;

a bulb; and a battery hatch for receiving and replacing a battery for supplying power to said bulb in response to actuation of said actuator.

19. The tool of claim 10, wherein said electronic device comprises a self-contained digital alarm clock.

20. The tool of claim 17, wherein said digital alarm clock includes at least one actuator arranged for setting clock functions of said digital alarm clock.

21. The tool of claim 10, further comprising a writing implement, wherein said first portion includes a slot for storing said writing implement.

22. The tool of claim 10, wherein said deployable implement includes a nail file having a tip with a flattened surface for use as a flathead screwdriver.

23. The tool of claim 10, wherein said deployable implement includes a cap lifter having a tip with a flattened end for use as a slot screwdriver.

24. The tool of claim 10, further comprising a scissor blade spring for biasing the deployed first and second scissor blades to an open position at a predetermined maximum angular orientation.

25. A multiple function tool comprising, as a unit:

a plurality of implements;

a flashlight;

a clock;

a first scale forming a first face of said tool; and a second scale forming a second face of said tool;

wherein:

said implements are pivotably coupled to said tool between said first and second scales; and said flashlight has a lens and is positioned in one of said first and second scales such that said flashlight and said lens are on a face of said tool.

26. The tool of claim 25, wherein an overmold is provided over at least a portion of at least one of said first and second scales.

27. The tool of claim 25, further comprising a flashlight housing including a compartment for receiving a battery;

wherein:

said flashlight and said battery compartment are oriented with respect to each other such that the longitudinal axis of a bulb provided in said flashlight is perpendicular to the longitudinal axis of a battery provided in said battery compartment.

28. The tool of claim 25, further comprising:

a flashlight housing including a compartment for receiving a battery; and a clock housing in which said clock is housed;

wherein:

said clock housing is pivotably coupled to said tool; and said flashlight housing has an interior portion positioned within said tool behind said clock housing such that pivoting of said clock housing away from said tool permits access to said flashlight housing interior.

29. The tool of claim 25, wherein the focal length of said lens is adjustable.

* * * * *